US006230944B1

(12) United States Patent
Castellano et al.

(10) Patent No.: US 6,230,944 B1
(45) Date of Patent: May 15, 2001

(54) ADJUSTABLE POURING DEVICE WITH SEALING CAP

(76) Inventors: James Anthony Castellano, 3333 N. Overhill, Chicago, IL (US) 60634; Donald Brian Schwartz, 846 E. Broadway, Milford, CT (US) 06460; Oleg Los, 10369 Dearlove #1C, Glenview, IL (US) 60025

( * ) Notice: Subject to any disclaimer, the term of this patent is extended or adjusted under 35 U.S.C. 154(b) by 0 days.

(21) Appl. No.: 08/947,787

(22) Filed: Oct. 9, 1997

(51) Int. Cl.[7] ..... B67D 3/00

(52) U.S. Cl. ..... 222/481.5; 222/484; 222/520; 222/569

(58) Field of Search ..... 222/478, 479, 222/481, 481.5, 482, 483, 484, 519, 520, 522, 525, 546, 548, 553, 562, 563, 567, 569

(56) References Cited

U.S. PATENT DOCUMENTS

| | | | | |
|---|---|---|---|---|
| 217,127 | * | 7/1879 | Luckhardt | 222/479 |
| 221,091 | * | 10/1879 | Newton . | |
| 500,260 | * | 6/1893 | Carter | 222/482 |
| 880,669 | * | 3/1908 | Keller | 222/481.5 |
| 1,745,011 | * | 1/1930 | Frejacques | 222/479 X |
| 1,913,393 | * | 6/1933 | Jones | 222/482 |
| 2,387,699 | * | 10/1945 | Bates | 222/481 X |
| 2,618,800 | * | 11/1952 | Raab . | |
| 2,642,207 | * | 6/1953 | Renzi | 222/479 |
| 2,785,839 | * | 3/1957 | Du Pree | 222/546 X |
| 2,825,495 | * | 3/1958 | Fazio | 222/478 |
| 2,828,054 | * | 3/1958 | Chiaramonte | 222/479 |
| 3,121,519 | * | 2/1964 | Cherba | 222/519 |
| 3,209,963 | * | 10/1965 | Krieps et al. | 222/546 X |
| 3,235,133 | * | 2/1966 | Zimmerman et al. | 222/478 |
| 3,422,998 | * | 1/1969 | Murray | 222/481 X |
| 3,630,419 | * | 12/1971 | Pierce | 222/478 |
| 3,834,596 | * | 9/1974 | Brady et al. | 222/520 |
| 3,966,099 | * | 6/1976 | Sanford, Jr. et al. | 222/567 X |
| 4,398,652 | * | 8/1983 | Ueda et al. | 222/479 X |
| 4,979,655 | * | 12/1990 | Gallucci | 222/519 |
| 5,110,017 | * | 5/1992 | Braun | 222/520 |
| 5,211,318 | * | 5/1993 | Govatzidakis | 222/479 |
| 5,402,920 | * | 4/1995 | Dhillon | 222/519 |

* cited by examiner

*Primary Examiner*—Joseph A. Kaufman

(57) ABSTRACT

A pour spout is provided for dispensing liquid from a fluid carrying vessel such as a liquor bottle. The pour spout includes an insertable member configured to engage an internal surface of the bottle neck and form a liquid tight seal therewith. An external spout extends from the insertable member for directing the flow of liquid out of the vessel. Within the pour spout, an internal flow channel extends through both the insertable member and the external spout, the flow channel forming a nozzle aperture at the end of the external spout allowing liquid contained within the vessel to flow through the spout. Finally, a sealable cap is operably attached to the external spout. The cap may be operated between an open and a closed position, wherein in the open position, liquid can flow through the cap, and in the closed position, an air tight seal is formed over the end of the spout.

16 Claims, 4 Drawing Sheets

ADJUSTABLE POURING DEVICE WITH SEALING CAP

BACKGROUND OF THE INVENTION

The present invention relates to a pour spout for dispensing liquid from a vessel such as a glass bottle.

Pour spouts for dispensing liquids are well known in the art. Such spouts can be commonly found in taverns and pubs where large amounts of liquor are dispensed from various sized bottles through the general course of business. During busy periods, a bar tender is often required to pour and mix drinks quickly in order to efficiently serve the patrons of the establishment. In addition to speed, accuracy is also important. It is undesirable that liquor is wasted through spillage or by dispensing excessive amounts of liquor into individual drinks. A pour spout inserted into the neck of a liquor bottle allows the fluid contents of the bottle to be poured out quickly and smoothly, in controlled manner. With a properly designed pour spout, the fluid contents of a bottle are dispensed in a narrow continuous stream, without the characteristic backing up of liquid in the throat of the bottle as is common when liquids are poured too quickly from bottles not fitted with a pour spout.

A typical pour spout including features common to most models is disclosed in U.S. Pat. No. 3,966,099 issued to Sanford, Jr. et al. There, a pour spout is disclosed including a lower portion which is insertable into the neck of a bottle; a vent tube; a spout; and a horizontal disc separating the lower insertable portion from the external spout portion. The lower insertable portion includes a plurality of resilient sealing fins which engage the internal surface of the bottle neck when the pour spout is inserted therein, forming a liquid tight seal which prevents fluid from leaking out of the bottle around the outer surfaces of the pour spout. A channel or bore is formed within the spout portion, and extends through the entire pour spout. Apertures at either end of the channel allow liquid to enter the lower portion of the pour spout inserted into the bottle neck, and be poured out through the aperture in the spout at the opposite end. The vent tube extends through the lower insertable portion of the pour spout and includes a second narrow bore. The second bore extends only as far as the horizontal surface of the disc, where a small aperture opens to the external environment surrounding the pour spot and bottle. When the contents of the bottle are to be poured out, the bottle is tipped from a vertical position toward a more horizontal orientation. The external spout portion is angled such that to pour the contents of the bottle, the bottle must be tipped in the same direction as the angle of the spout. This ensures that the fluid contents of the bottle will properly enter the pouring channel without requiring excessive tipping of the bottle. As the liquid is dispensed out of the bottle through the spout, the vent tube allows air to enter the bottle, equalizing the pressure within the bottle and preventing the contents of the bottle from backing up and pouring out in an uneven manner. While there have been innumerable variations to the basic design just described, these basic features are common to most, if not all, presently used beverage pour spouts.

As noted, pour spouts such as that disclosed in the U.S. Pat. No. 3,966,099 patent are typically used by taverns and pubs and other purveyors liquors and spirits. The bottles in which such pours spouts are most often inserted are bottles containing liquor of one kind or another, such as whiskey, gin, vodka, and others. Generally most liquor dispensing establishments will have an entire assortment of liquor bottles lined up behind the bar, each opened, and each having a pour spout inserted into the neck thereof Thus, in the crush of business, a bar tender need only reach for a particular bottle and quickly pour a controlled volume of liquid into a glass in order to mix a particular drink requested by a patron. Having pour spouts in all of the bottles greatly increases the bar tender's efficiency, and cuts down on excess spillage and over filling of drinks.

Using pour spouts on such a widespread basis, however, generates a number of problems for the operator of the establishment. Most significantly, in order to reseal a particular bottle, the pour spout must be removed and the original cap replaced on the bottle. This can create confusion in storing a large number of bottle caps and returning the proper cap to the proper bottle. Also, this greatly increases the effort required to both open the establishment at the beginning of the business day, and close it again at the end of the shift. One option to avoid this problem is to simply leave the pour spouts in the bottles during off hours. However, in doing so the operator risks losing much of the contents of each bottle to evaporation. Furthermore, leaving the bottles open can lead to unwanted air born contaminants entering the bottles. Such contaminants may include insects, dust particles, air born chemicals, or other air born agents.

Some prior art pour spouts have attempted to address this issue, albeit imperfectly. For example some prior art pour spouts include perpendicular cross members placed across the pouring channel adjacent the opening in the end of the spout. The cross members act as a crude filter, keeping larger contaminants from entering the bottle. However, this solution fails to check the infiltration of smaller contaminants, and it does nothing to prevent evaporation of the liquid contents of the bottle. Furthermore, the cross members interfere with the flow of liquid through the spout, interrupting the smooth pouring of the liquid out of the bottle. Another solution has been to stretch a finer filter such as a wire screen across the spout's pouring channel. This has a less degrading effect on the flow of liquid through the spout, and also blocks finer particles from contaminating the bottle, but still does not address the problem of evaporation.

What is needed is a pour spout which can be inserted into the neck of a fluid containing vessel through which the liquid contents of the vessel can be poured in a smooth and controlled manner. Such a pour spout should provide a mechanism by which the vessel may be stopped with an air tight seal without removing the pour spout from the bottle. The stopper mechanism must be configured such that it is easily operated, and seals both the pouring channel, and the adjacent vent tube to prevent evaporation of the contents of the bottle. Furthermore, such a pour spout should be easily manufactured and inexpensive to produce. Preferably, the pour spout should be made of plastic by injection molding.

SUMMARY OF THE INVENTION

In light of the prior art as described above, one of the main objectives of the present invention is to provide a self sealing pour spout insertable into the neck of a fluid carrying vessel such that the contents of the vessel may be poured out in a smooth and controlled manner.

A further object of the present invention is to provide a resealable pour spout which prevents air born particles from entering the vessel.

Another objective of the present invention is to provide a resealable pour spout in which both the spout aperture and the vent aperture are sealed when the liquids are not being dispensed from the vessel.

Still another objective of the present invention is to provide a resealable pour spout in which the liquid can be poured in a smooth and uninterrupted manner.

Yet another objective of the present invention is to provide a resealable pour spout with which it is possible to control the flow of liquid therethrough.

All of these objectives, as well as others that will become apparent upon reading the detailed description of the presently preferred embodiment of the invention, are met by the Adjustable Pouring Device With Sealing Cap herein disclosed. The present invention provides a pouring spout configured to be insertable into the neck of a liquid containing vessel such as a glass bottle for storing liquors and other beverages. The pour spout facilitates the dispensing of liquid from the vessel by directing fluid out of the vessel in a narrow controlled stream while simultaneously allowing air to flow into the vessel, thereby preventing the liquid from backing up in the neck of the vessel. The pour spout includes a sealing member which fits over the end of the spout and provides a mechanism by which the vessel may be sealed without removing the pour spout from the vessel.

Generally, the pour spout comprises a lower insertable portion configured to engage the inner surface of a bottle's neck, and an external spout configured to guide the fluid contents of the bottle as the contents are poured out. The insertable portion includes flexible annular sealing fins which are deformed by the inner surface of the bottleneck forming a liquid tight seal therewith. The spout comprises an angled nozzle configured to direct the flow of liquid out of the vessel. A first internal bore extends through the spout providing a flow channel for dispensing liquid from the bottle. When the contents of the bottle are poured out, the liquid enters the flow channel through a relatively large opening in the lower insertable portion of the pour spout, and is directed into a narrow stream by the external nozzle. A second passage extends through the pour spout, and is configured as a vent tube. The vent tube allows air into the vessel as the liquid contents are poured out, thereby equalizing the air pressure inside and outside of the vessel. The air inlet to the vent tube is located on the nozzle, above the angled section thereof.

A cylindrical sealing cap is provided which is configured to fit over the dispensing end of the nozzle. The cap is slidably or rotatably operated to open and close the flow channel and vent tube. In a preferred embodiment the cap is permanently attached to the nozzle by using a series of overlapping annular rings formed on the outer surface of the nozzle and the inner surface of the cap. A first pair of overlapping rings prevent the cap from being completely withdrawn from the nozzle, and a second pair provide a tactile sealing detent for maintaining the cap in an open position. Alternate arrangements for retaining the cap on the end of the nozzle are also available such as mating threads, or mounting posts and mating grooves such as a bayonet configuration, or any other retaining mechanisms known in the art.

In the preferred embodiment a conical plug extends inward from the end of a sealing cap, and is insertable into the opening of the pouring channel located at the end of the nozzle. The circular base of the plug has a diameter somewhat larger than the inner diameter of the cylindrically shaped cap. A plurality of arcuate slots are formed through the end of the cap around the base of the plug. When the cap is pulled forward, or rotated into the open position, the plug is removed from the opening of the nozzle, and the liquid contents of the vessel are free to flow around the plug and through the apertures formed in the end of the cap. The conical shape of the plug helps to deflect the contents in a smooth manner so that the liquid flow out of the spout remains a smooth and steady stream. When the cap is pushed onto the nozzle, or rotated into the closed position, the plug is forced into the nozzle, blocking the flow channel through the spout and sealing the vessel or bottle.

An additional feature of the present invention is the arrangement of the vent tube in relation to the external spout portion. The position of the vent tube air inlet above the angled section of the nozzle allows the cylindrical walls of the sealing cap to extend over the inlet when the cap is placed in the closed position. Thus, the sealing cap seals the vent tube as well as the nozzle when in closed position, thereby preventing evaporation of the contents of the bottle. When the sealing cap is pulled forward, or rotated to the open position, the cylindrical walls of the sealing cap are pulled forward as well, exposing the vent tube air inlet and allowing air to flow into the bottle.

DETAILED DESCRIPTION OF THE PRESENTLY PREFERRED EMBODIMENTS

Figure 1:
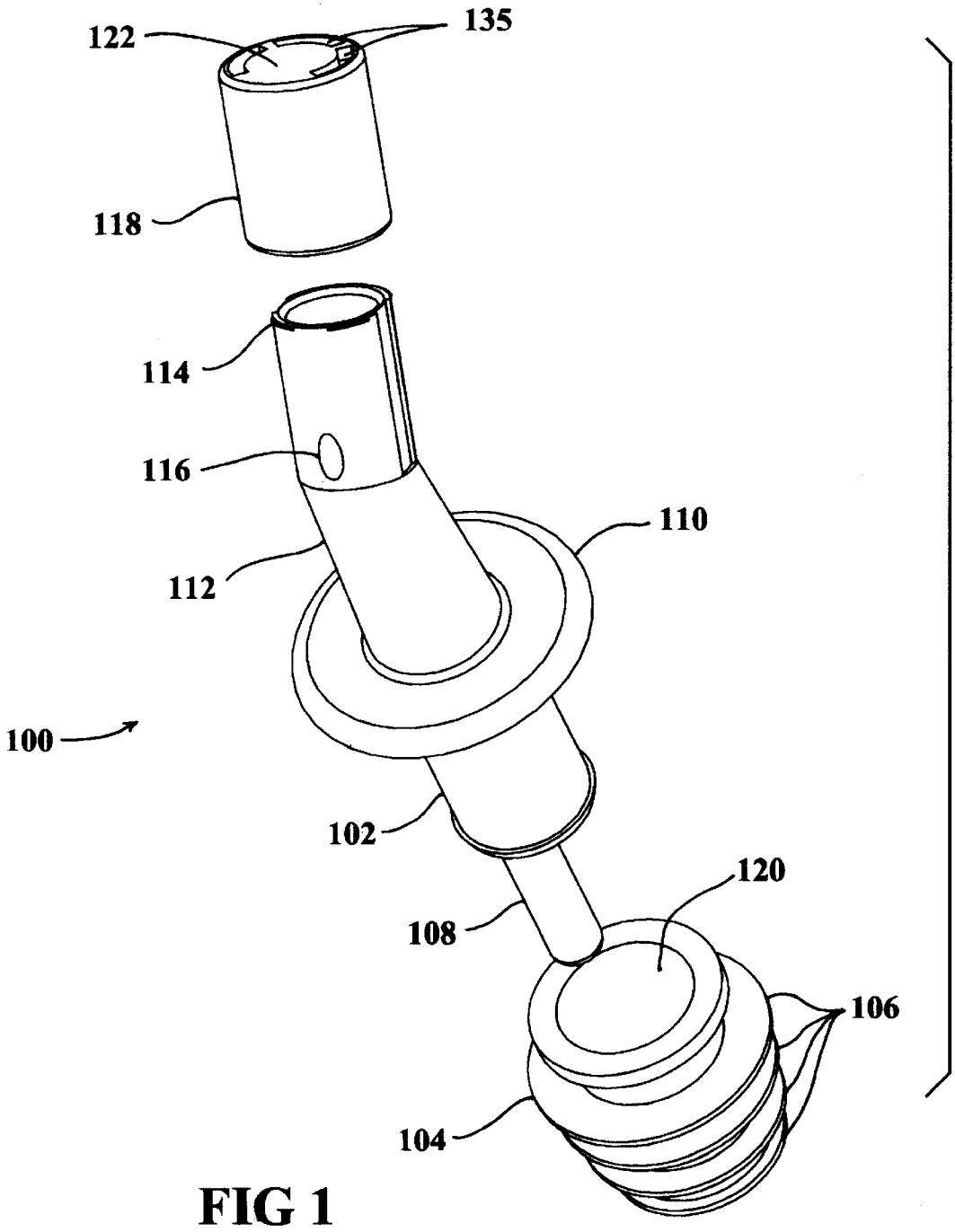
FIG. 1 is an exploded perspective view of a pour spout according to the present invention.
Figure 2:
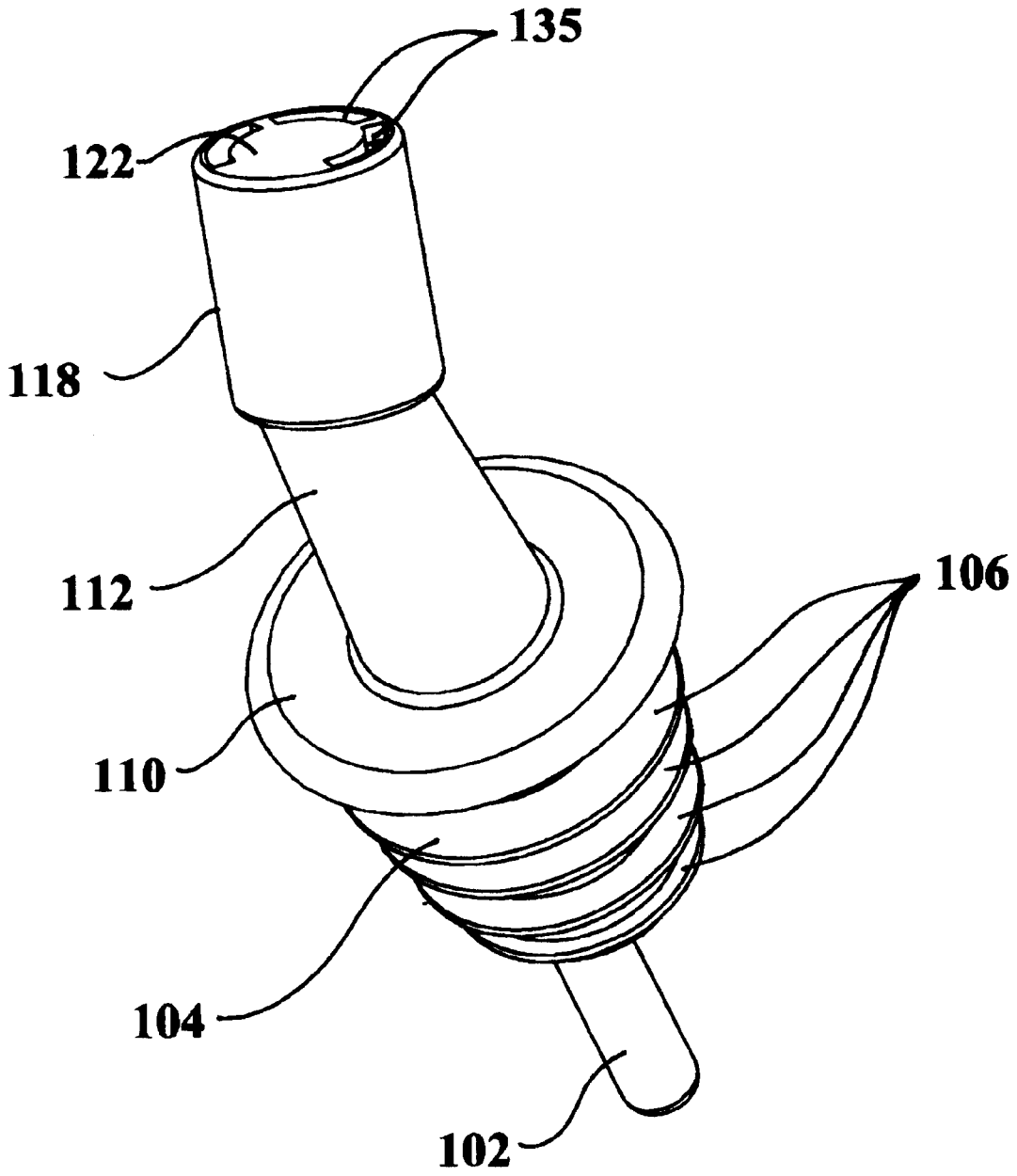
FIG. 2 is an assembled perspective view of a pour spout according to the present invention.

Turning to FIG. 1 an exploded view of a pour spout 100 according to the present invention is shown. The pour spout includes a lower insertable end 102 which is configured to be inserted into the neck portion of a fluid containing vessel such as a liquor bottle (vessel not shown). Lower portion 102 includes a sealing member 104 formed of a resilient material and having a plurality of horizontal sealing fins 106 which, when inserted into a vessel, compress against the inner surface of the vessel's neck, forming a liquid tight seal therewith. The annular disc 110 acts as a physical stop preventing the spout from being inserted too far into the vessel. Pour spout 100 further includes a vent tube 108, an annular disc 110, an external spout including an output nozzle 114, a vent opening 116, and a sealing cap 118. When assembled, as shown in FIG. 2, an internal bore 120 through sealing member 104 slides over the lower insertable portion 102, forming an interference fit therewith. Sealing cap 1 18 is cylindrical in shape, and slides over nozzle 114, and covers the end of spout 112. The end surface 122 of sealing cap 118 is formed with a plurality of arcuate slots 135 which extend through the cap. As will be discussed in more detail below, the slots allow liquid to flow through the sealing cap 118 without removing the cap from spout 112.

Figure 3:
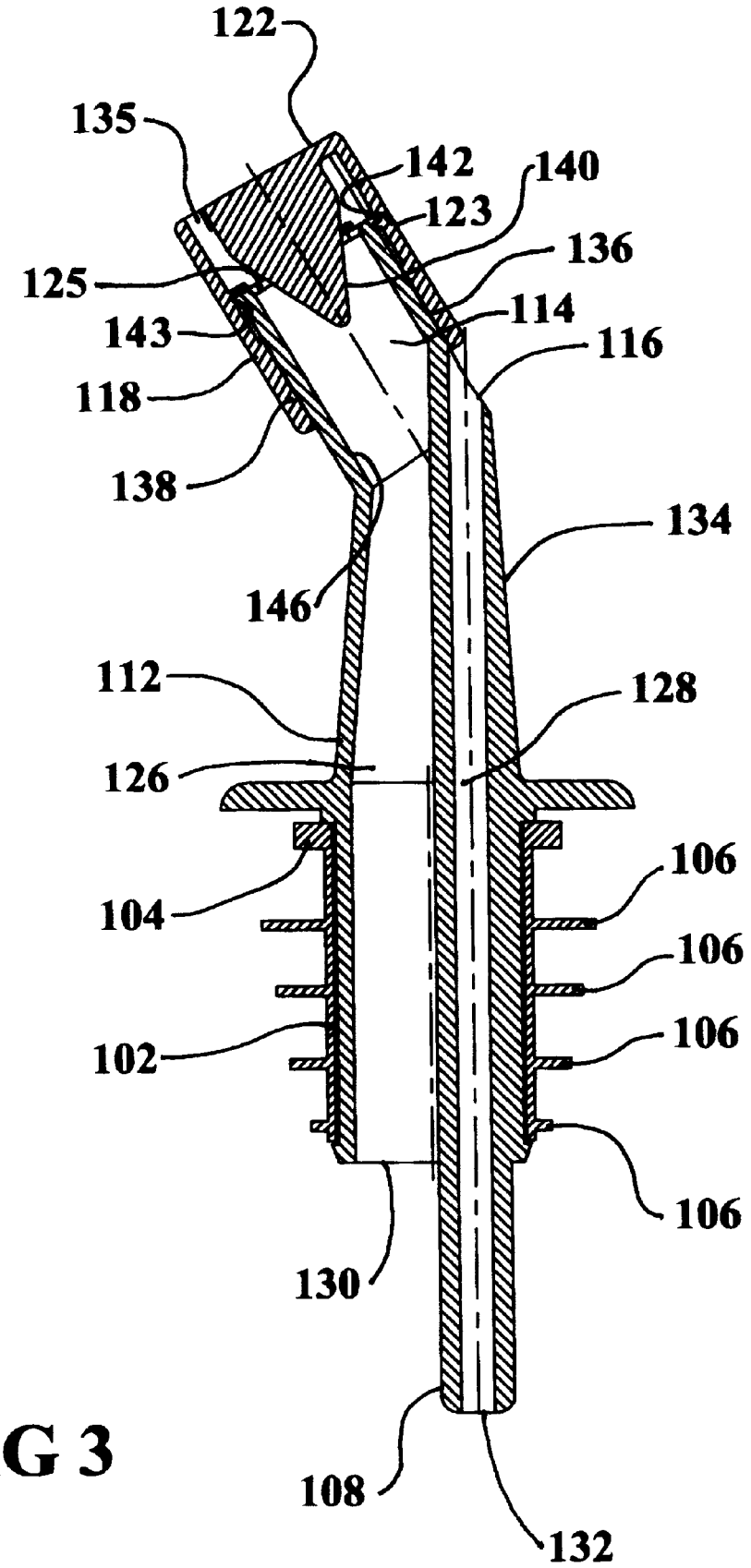
FIG. 3 is a cross sectional view of a pour spout according to the present invention showing the resealable cap in the open position.

Turning now to FIG. 3, a cross sectional view of the pour spout is shown. As can be seen, internally pour spout 100 is divided into two hollow channels. A first channel 126, larger than the second channel 128, extends the entire length of the pour spout, ending in apertures at each end. The first channel 126 comprises the liquid flow channel through which the contents of the vessel are dispensed. The circular aperture in the end of the spout 112 defines the nozzle 114. A second aperture located at the bottom of the insertable portion 102, defines the fluid intake 130 of pour spout 100. The second, narrower channel 128 is formed as the hollow bore defined by vent tube 108. Vent tube 128 extends further than the remainder of lower insertable portion 102, so that when inserted into the neck of a vessel, the outlet 132 of vent tube 108 is not located near the fluid intake 130 of the pour spout 100. This helps to prevent liquid from entering the vent tube as the contents of the vessel are being poured out. The vent opening 116 at the opposite end of vent tube 108 acts as the air intake, allowing air to flow into the vessel as the liquid is poured out.

As can be clearly seen in FIG. 3, the external spout 112 is comprised to two separate segments. A first straight segment 134 rises perpendicular to the surface of the horizontal disc 110, and a second straight segment 136 extends from the end of the first segment 132 at an angle of approximately 30°. Vent tube 108 extends straight through the entire body of pour spout 100 such that the vent opening 116 is formed on the surface of the second straight segment 136 of external spout 112, just beyond the intersection of the first and second segments 134, 136. An external annular ridge 123 surrounds nozzle 114 providing a lip or ledge around the end of the external spout 112. Internally, nozzle 114 is formed with a beveled edge 125.

The sealing cap 118 is cylindrical in shape with an annular sidewall 138 extending from the outer diameter of the disc shaped end surface 122. The sidewall 138 is sized to fit over nozzle 114, and slidably engage the outer surface of the angled section 136 of external spout 112. An internal conical stopper 140 protrudes inwardly from the end of sealing cap and is insertable into the aperture of nozzle 114. The diameter of stopper 140 at the base is approximately the same or slightly larger than the inner diameter of the flow channel 126 in the area immediately adjacent the nozzle 114. The arcuate slots 135 formed in the end of sealing cap 118 are positioned around the base of stopper 140. Finally, a series of internal annular ridges 142 and 143 are formed on the inner surface of the cylindrical sidewall of sealing cap 118. The internal annular ridges 142, 143 cooperate with the external ridge 123 extending around the nozzle 114 to form detents restricting the motion of sealing cap 118.

Figure 4:
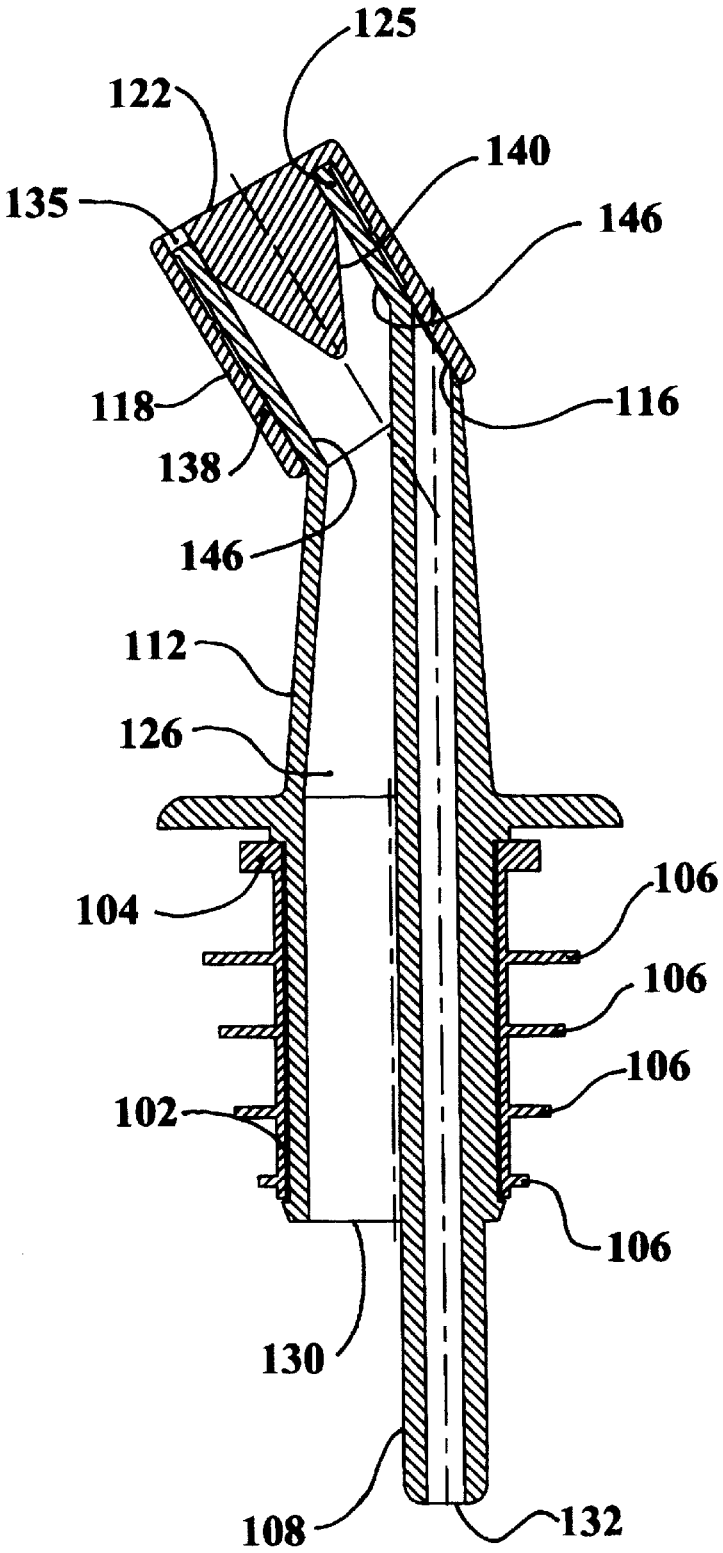
FIG. 4 is a cross sectional view of a pour spout according to the present invention showing the resealable cap in the closed position.

Referring to both FIG. 3 and FIG. 4, the operation of sealing cap will now be described. Sealing cap 118 is configured to slide back and forth along the angled segment 136 of the external spout 112 in the directions indicated by arrows A and B. When sealing cap 118 is pulled forward in the direction of Arrow A as shown in FIG. 3, stopper 140 is partially withdrawn from nozzle 114. This corresponds to the "open" position. In this position, a gap exists between the angled sides of stopper 140 and the walls 146 of flow channel 126. This gap allows liquid to flow past stopper 140 and through the arcuate slots 135 surrounding the base of the stopper. Thus, with sealing cap 118 pulled forward, the contents of the vessel may be poured through pour spout 100 and out the end of the sealing cap 118. It should also be noted that with sealing cap 118 pulled forward in the open position, sidewall 138 is clear of vent opening 116. This allows air to flow into the vessel as the liquid contents of the vessel are poured out. The conical shape of stopper 140 helps to shape the resultant stream of liquid exiting the spout by providing a gradual and consistent deflection of the liquid toward arcuate slots 135. The result is a smooth coherent stream of liquid out of the pour spout 100 as the contents of the vessel are dispensed.

In the open position, FIG. 3, the external ridge 123 surrounding nozzle 114 is locked in between the internal ridges 142,143 formed on sidewall 138 of sealing cap 118, the ridge 142 preventing the sealing cap 118 from being completely withdrawn from the spout.

Pour spout 100 is closed by pushing sealing cap 118 backward onto the angle segment 136 of external spout 112. This position is shown in FIG. 4. As the cap is moved over the spout in the direction of Arrow B, conical stopper 140 is forced into nozzle 114. The beveled edge 125 of the nozzle 114, and the angled sides of the stopper 140 help to align the stopper 140 and ensure that the stopper is seated properly within the flow channel 126. When fully closed, stopper 140 is fully inserted within flow channel 126 and nozzle 114 abuts the end 122 of sealing cap 118, thereby blocking the plurality of arcuate slots 135. As noted previously, the base diameter of stopper 140 is slightly greater than the inner diameter of the flow channel in the area near nozzle 114. Thus, when stopper 140 is pushed into nozzle 114, the base of stopper 140 physically engages the inner surface 146 of flow channel 126 forming an air tight seal therewith. In addition to blocking the nozzle 114, sealing cap 118 also seals the vent tube 108 as well. When sealing cap 118 is pushed backward over external spout 112, sidewall 136 slides over vent opening 116. This forms an air tight seal over the vent tube. Therefore, with the sealing cap 118 placed in the closed position, the vessel into which the pour spout 100 has been inserted will be completely sealed, and the contents thereof will not be subject to evaporation.

Sealing cap 118 is maintained in the closed position by the pressfit interference created in between the stopper wall 140 and the inner surface 146.

As sealing cap 118 is brought in open position, the external ridge 123 interferes with the first internal ridge 143. An extra amount of force is required to overcome this interference. When the interference is overcome, the sealing cap snaps open, and the external ridge 123 is held in place between internal ridges 142, 143. A similar amount of extra force is required to overcome the interference between ridges 123 and 143 in order to close sealing cap 118 as well. The snapping action generated when the interference between the two ridges is overcome provides a tactile indication that the cap has been opened or closed.

While the interference arrangement between overlapping ridges is the preferred mode of maintaining the sealing cap in the open or closed positions, other methods are contemplated. For example one skilled in the art should be aware that cooperating threads on the outer surface of spout 112 and the inner surface of sidewall 134 could easily be substituted for the cooperating ridges just described. Similarly, a bayonet configuration, comprising mounting posts and mating grooves may also be used.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A pour spout for dispensing from a vessel comprising:

an insertable member configured to engage a dispensing aperture of the vessel;

an external spout extending from the insertable member;

an internal flow channel extending through the insertable member and the external spout, the flow channel forming a nozzle aperture at the end of the external spout allowing liquid contained within the vessel to flow therethrough;

a vent tube configured to extend through the insertable member and the external spout for enabling air to flow into the vessel, the vent tube having an air intake aperture located on an outer surface of the external spout, the air intake aperture located at a predetermined distance before the end of the external spout;

a sealable cap operably attached to the external spout, the sealable cap having a closed position and an open position, the cap being selectively and slidably operable between the open position and the closed position, the sealable cap configured to cover the vent tube when in the closed position and to uncover the vent tube when in the open position; and means for enabling the sealable cap to remain attached to the external spout when the cap is in the open position.

2. The pour spout of claim 1 wherein the cap when placed in the closed position forms an air tight seal with the nozzle aperture and the vent tube.

3. The pour spout of claim 2 wherein the sealable cap further includes in internal stopper configured to slidably engage the nozzle aperture, the stopper having a base perimeter dimension approximately equal to the nozzle aperture.

4. The pour spout of claim 3 wherein the internal stopper has the shape of a circular cone, the pointed end of the circular cone oriented such that liquid flow is first smoothed by the pointed end of the stopper before the liquid exits from the nozzle aperture at the end of the external spout.

5. The pour spout of claim 1 wherein the sealing cap being placed in the closed position forms an air tight seal with the air intake aperture.

6. The pour spout of claim 1 wherein the sealable cap defines at least one dispensing aperture, and wherein the sealing cap is selectively operable between an open position and a closed position, the cap being placed in the open position allowing the liquid contents of the vessel to flow through at least one dispensing aperture.

7. A sealable liquid dispenser for enabling an operator to pour liquid from a bottle in a controlled manner, the dispenser comprising:

a pour spout having a first end and a second end, the first end being configured to engage an inner surface of the bottle, the second end forming a nozzle for controlling the flow of liquid from the pour spout;

a flow channel extending through the pour spout, the flow channel including a fluid intake located at the first end of the pour spout, and a fluid outlet located within the nozzle;

a vent tube extending through the pour spout including an air intake located at a predetermined location between the first end and the second end, and an air outlet located at the first end of the pour spout;

a sealable cap operably attached to the second end of the pour spout, the sealable cap adapted to cover the air outlet and the fluid outlet when in a closed position and to uncover the air outlet and the fluid outlet when in an open position, the cap being selectively and slidably operable between the open position and the closed position; and means for enabling the sealable cap to remain attached to the external spout when the cap is in the open position.

8. The liquid dispenser of claim 7 wherein the sealable cap is operable between a first retracted position and a second extended position.

9. The liquid dispenser of claim 8 wherein the sealable cap placed in the retracted position forms an air tight seal over the fluid outlet and the air intake.

10. The liquid dispenser of claim 9 wherein the sealable cap includes a plurality of slots formed in a surface thereof, the cap placed in the extended positions the slot communicating with the flow channel allowing fluid contained within the bottle to flow therethrough.

11. The liquid dispenser of claim 10 wherein the sealable cap is formed as a cylindrical member having a circular end with an annular sidewall extending therefrom configured to slidably engage an outer surface of the pour spout, the plurality of slots being formed in the circular end.

12. The liquid dispenser of claim 11 wherein the sealable cap further comprises an internal plug extending from circular end of the cap, the internal plug having a base diameter less than the diameter of sealable cap annular sidewall, and the plurality of slots being arrayed around the base of the internal plug.

13. The liquid dispenser of claim 11 wherein the fluid outlet has a circular dimension slightly smaller than the base dimension of the internal plug.

14. A pour spout for dispensing liquid from a container comprising:

an insertable member having an annular outer surface for engaging an opening in the container;

a spout having an external annular ridge, the spout extending from the insertable member to direct liquid flowing from inside the container to exit the container at an opening;

a vent tube extending through the spout and the insertable member, the vent tube having an aperture formed in the spout and located a predetermined distance away from the opening;

a cap having an internal annular ridge, the cap operably attached to the spout, the cap being selectively and slidably operable between an open position and a closed position; and a plug associated with the cap configured to seal the spout when the cap is placed in the closed position, the ridges forming an interference detent to maintain the cap in an open position.

15. The sealing cap of claim 14 wherein the cap in a closed position forms an air tight seal over the vent tube.

16. The pour spout of claim 14 wherein the cap in the open position allows the liquid contents of the vessel to flow through at least one dispensing aperture.

* * * * *